US007250069B2

(12) United States Patent
Kembaiyan et al.

(10) Patent No.: US 7,250,069 B2
(45) Date of Patent: Jul. 31, 2007

(54) HIGH-STRENGTH, HIGH-TOUGHNESS MATRIX BIT BODIES

(75) Inventors: Kumar T. Kembaiyan, The Woodlands, TX (US); Thomas W. Oldham, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 273 days.

(21) Appl. No.: 10/464,873

(22) Filed: Jun. 18, 2003

(65) Prior Publication Data

US 2004/0060742 A1 Apr. 1, 2004

Related U.S. Application Data

(60) Provisional application No. 60/414,135, filed on Sep. 27, 2002.

(51) Int. Cl.
*C22C 29/08* (2006.01)
*E21B 10/46* (2006.01)

(52) U.S. Cl. ..... 75/236; 175/374; 51/307

(58) Field of Classification Search ..... 75/240, 75/242; 428/545, 546; 175/374; 51/307
See application file for complete search history.

(56) References Cited

U.S. PATENT DOCUMENTS

| | | | | |
|---|---|---|---|---|
| 4,525,178 | A | 6/1985 | Hall | 51/309 |
| 5,290,507 | A | 3/1994 | Runkle | 419/14 |
| 5,880,382 | A * | 3/1999 | Fang et al. | 75/236 |
| RE37,127 | E * | 4/2001 | Schader et al. | 75/239 |
| 6,659,206 | B2 * | 12/2003 | Liang et al. | 175/374 |
| 6,682,580 | B2 * | 1/2004 | Findeisen et al. | 75/236 |
| 2002/0084111 | A1 | 7/2002 | Evans | 175/374 |
| 2003/0000339 | A1 | 1/2003 | Findeisen et al. | 72/240 |

FOREIGN PATENT DOCUMENTS

| | | |
|---|---|---|
| CA | 2410122 | 4/2003 |
| DE | 10157079 | 2/2003 |
| GB | 2295157 | 5/1996 |
| GB | 2295175 | 5/1996 |
| GB | 2315777 | 2/1998 |

OTHER PUBLICATIONS

United Kingdom Combined Search and Examination Report, dated Dec. 12, 2003, 5 pages.
Canadian Official Action dated Jan. 11, 2006.
Canadian Official Action issued in Application No. 2,442,198 dated Oct. 31, 2006 (2 pages).

* cited by examiner

*Primary Examiner*—Roy King
*Assistant Examiner*—Ngoclan T. Mai
(74) *Attorney, Agent, or Firm*—Osha Liang LLP

(57) ABSTRACT

A new composition for forming a matrix body which includes spherical sintered tungsten carbide and an infiltration binder including one or more metals or alloys is disclosed. In some embodiments, the composition may include a Group VIIIB metal selected from one of Ni, Co, Fe, and alloys thereof. Moreover, the composition may also include cast tungsten carbide. In addition, the composition may also include carburized tungsten carbide.

15 Claims, 1 Drawing Sheet

HIGH-STRENGTH, HIGH-TOUGHNESS MATRIX BIT BODIES

CROSS-REFERENCE TO RELATED APPLICATIONS

This application claims the priority under 35 U.S.C. §119 to U.S. Application Ser. No. 60/414,135, filed Sep. 27, 2002. That application is incorporated by reference in its entirety.

BACKGROUND OF INVENTION

1. Field of the Invention

This invention relates generally to a composition for the matrix body of rock bits and other cutting or drilling tools.

2. Background Art

Polycrystalline diamond compact ("PDC") cutters are known in the art for use in earth-boring drill bits. Typically, bits using PDC cutters include an integral bit body which may be made of steel or fabricated from a hard matrix material such as tungsten carbide (WC). A plurality of PDC cutters is mounted along the exterior face of the bit body in extensions of the bit body called "blades." Each PDC cutter has a portion which typically is brazed in a recess or pocket formed in the blade on the exterior face of the bit body.

The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

While steel body bits may have toughness and ductility properties which make them resistant to cracking and failure due to impact forces generated during drilling, steel is more susceptible to erosive wear caused by high-velocity drilling fluids and formation fluids which carry abrasive particles, such as sand, rock cuttings, and the like. Generally, steel body PDC bits are coated with a more erosion-resistant material, such as tungsten carbide, to improve their erosion resistance. However, tungsten carbide and other erosion-resistant materials are relatively brittle. During use, a thin coating of the erosion-resistant material may crack, peel off or wear, exposing the softer steel body which is then rapidly eroded. This can lead to loss of PDC cutters as the area around the cutter is eroded away, causing the bit to fail.

Tungsten carbide or other hard metal matrix body bits have the advantage of higher wear and erosion resistance. The matrix bit generally is formed by packing a graphite mold with tungsten carbide powder and then infiltrating the powder with a molten copper-based alloy binder. For example, macrocrystalline tungsten carbide and cast tungsten carbide have been used to fabricate bit bodies. Macrocrystalline tungsten carbide is essentially stoichiometric WC which is, for the most part, in the form of single crystals. Some large crystals of macro-crystalline WC are bi-crystals. Cast tungsten carbide, on the other hand, generally is a eutectic two-phase carbide composed of WC and $W_2C$. There can be a continuous range of compositions therebetween. Cast tungsten carbide typically is frozen from the molten state and comminuted to a desired particle size.

A third type of tungsten carbide used in hardfacing is cemented tungsten carbide, also known as sintered tungsten carbide. Sintered tungsten carbide comprises small particles of tungsten carbide (e.g., 1 to 15 microns) bonded together with cobalt. Sintered tungsten carbide is made by mixing organic wax, tungsten carbide and cobalt powders, pressing the mixed powders to form a green compact, and "sintering" the composite at temperatures near the melting point of cobalt. The resulting dense sintered carbide can then be crushed and comminuted to form particles of sintered tungsten carbide for use in hardfacing.

Sintered tungsten carbide is commercially available in two basic forms: crushed and pelletized. Crushed sintered tungsten carbide is produced by crushing sintered components into finer particles, the shape of which tends to be irregular and angular. Pelletized sintered tungsten carbide is generally rounded or spherical in shape. Spherical sintered tungsten carbide is typically manufactured by mixing tungsten carbide powder having a predetermined size (or within a selected size range) with a suitable quantity of cobalt or nickel, then formed into pellets (round globules). These pellets are sintered in a controlled atmosphere furnace to yield spherical sintered tungsten carbide. The particle size and quality of the spherical sintered tungsten carbide can be tailored by varying the initial particle size of tungsten carbide and cobalt, controlling the pellet size and adjusting the sintering time and temperature.

However, a bit body formed from the either cast or macrocrystalline tungsten carbide or other hard metal matrix materials may be brittle and may crack when subjected to impact and fatigue forces encountered during drilling. This can result in one or more blades breaking off the bit causing a catastrophic premature bit failure. Additionally, the braze joints between the matrix material and the PDC cutters may crack due to these same forces. The formation and propagation of cracks in the matrix body and/or at the braze joints may result in the loss of one or more PDC cutters. A lost cutter may abrade against the bit, causing further accelerated bit damage.

For the foregoing reasons, there is a need for a new matrix body composition for drill bits which has high strength and toughness, resulting in improved ability to retain blades and cutters, while maintaining other desired properties such as wear and erosion resistance.

SUMMARY OF INVENTION

In one aspect, the invention relates to a new composition for forming a matrix body which includes spherical sintered tungsten carbide and an infiltration binder including one or more metals or alloys. In some embodiments, the new composition may include a Group VIIIB metal selected from one of Ni, Co, Fe, and alloys thereof. Moreover, the composition may also include carburized tungsten and/or cast tungsten carbide.

In one aspect, the invention relates to a matrix body which includes spherical sintered tungsten carbide and an infiltration binder including one or more metals or alloys. In some embodiments, the new composition may include a Group VIIIB metal selected from one of Ni, Co, Fe, and alloys thereof. Moreover, the matrix body may also include cast tungsten carbide.

Other aspects and advantages of the invention will be apparent from the following description and the appended claims.

DETAILED DESCRIPTION

Figure 1:
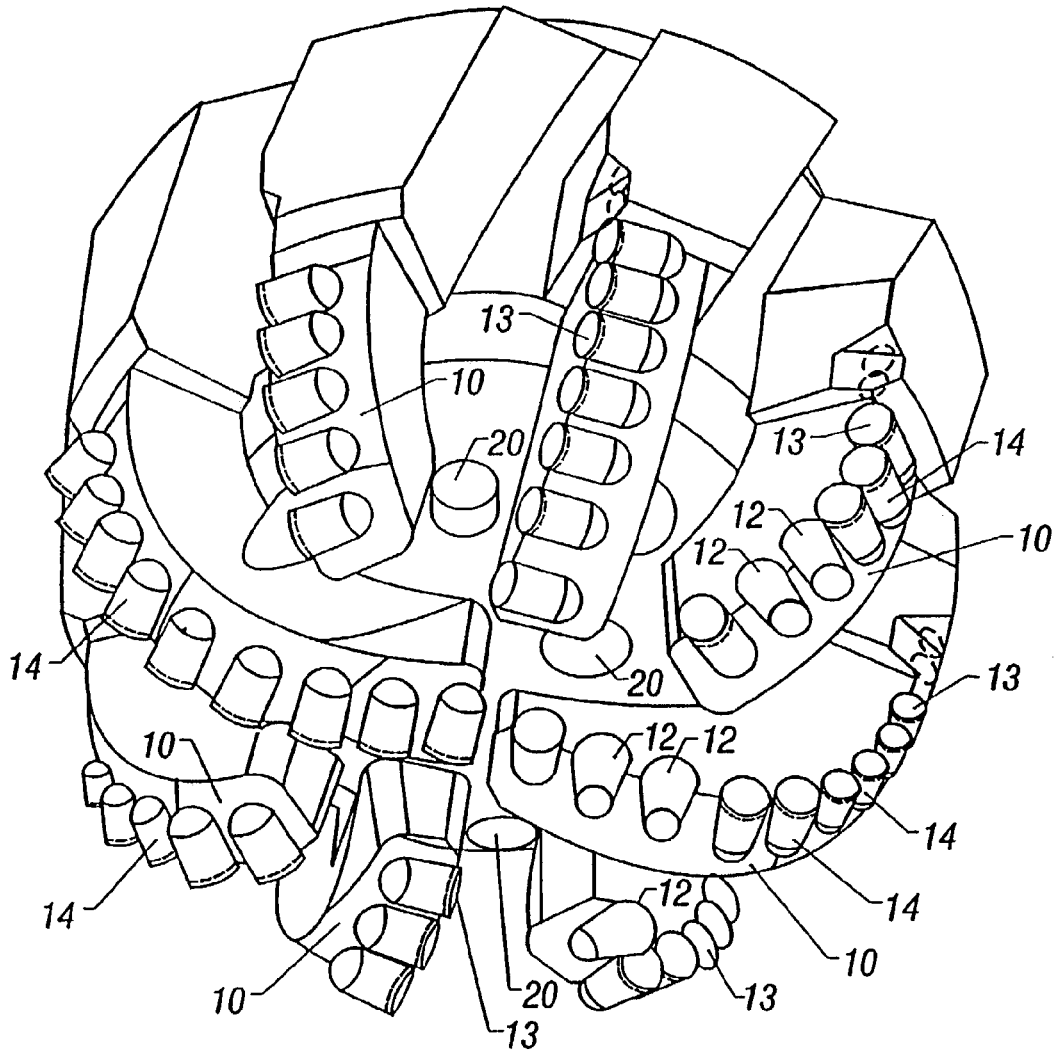
FIG. 1 is a perspective view of an earth-boring PDC drill bit body with some cutters in place according to an embodiment of the invention.

The invention is based, in part, on the determination that the strength (also known as transverse rupture strength) and toughness of a matrix body is related to the life of such a bit. Cracks often occur where the cutters (typically polycrystalline diamond compact—"PDC") are secured to the matrix body, or at the base of the blades. The ability of a matrix bit body to retain the blades is measured in part by its transverse rupture strength. The drill bit is also subjected to varying degrees of impact loading while drilling through earthen formations of varying hardness. It is important that the bit possesses adequate toughness to withstand such impact loading. It is also important that the matrix body possesses adequate braze strength to hold the cutters in place while drilling. If a matrix bit body does not provide sufficient braze strength, the cutters may be sheared from the drill bit body and the expensive cutters may be lost. In addition to high transverse rupture strength (TRS), toughness and braze strength, a matrix body also should possess adequate steel bond strength (the ability of the matrix to bond with the reinforcing steel piece placed at the core of the drill bit) and erosion resistance.

Embodiments of the invention provide a high-strength, high-toughness matrix body which is formed from a new composition that includes spherical sintered tungsten carbide infiltrated by a suitable metal or alloy as an infiltration binder. Such a matrix body has high transverse rupture strength and toughness while maintaining desired braze strength and erosion resistance. In one or more embodiments of the present invention, the use of spherical sintered carbides advantageously results in superior matrix properties.

Advantageously, in one or more embodiments of the present invention, spherical sintered tungsten carbide offers higher packing density than macrocrystalline tungsten carbide, crushed cast or crushed sintered tungsten carbide. In one embodiment, the spherical sintered tungsten carbide has an average tungsten carbide particle size of between about 0.2 μm to about 20 μm. In a preferred embodiment the spherical sintered tungsten carbide has an average tungsten carbide particle size of about 1 μm to about 5 μm. For a given volume, the spherical particles offer maximum particle density. In contrast, when using macrocrystalline or crushed carbides, the particles are angular and tend to pack loosely. In an infiltrated matrix, the higher packing density of spherical sintered carbide manifests itself into higher tungsten carbide phase which increases the wear resistance and strength.

Also advantageously, in one or more embodiments of the present invention, spherical sintered pellets advantageously avoid micro-strains because of their uniform shape and because they are not crushed. In contrast, when using macrocrystalline, crushed cast or crushed sintered tungsten carbide, the particles often become strained or cracked from the crushing process. This damage makes the particles more vulnerable to crack initiation and propagation during service. As a result, the strength and toughness of the final infiltrated matrix is reduced.

Another advantage of spherical sintered pellets is that they enable more efficient infiltration of the binder alloy. Because the capillary pathways in packed spherical particles are more uniform and narrower than those in packed crushed particles, the driving force for capillary infiltration is stronger and more efficient in the former case than the latter. Accordingly, the spherical sintered tungsten carbide particles tend to form stronger bonds with the infiltrant than the crushed sintered tungsten carbide particles.

In a first embodiment, a composition in accordance with the present invention included 72% by weight spherical tungsten carbide, 20% carburized tungsten carbide, 6% nickel and 2% iron. This composition was tested for transverse rupture strength (TRS), toughness, braze strength, steel bonding and erosion resistance using techniques known in the art. For comparison purposes, a prior art composition that included 76% by weight of macrocrystalline tungsten carbide, 16% cast tungsten carbide, and 8% nickel was also tested. The results are summarized in Table 1 below.

| | Composition 1 | Prior Art Composition |
|---|---|---|
| Sintered Spherical WC | 72% | 0% |
| Macrocrystalline WC | 0% | 76% |
| Cast $WC/W_2C$ | 0% | 16% |
| Carburized WC | 20% | 0% |
| Nickel | 6% | 8% |
| Iron | 2% | 0% |
| Braze Strength (lbs)--higher is better | 20,000 | 18,000 |
| TRS (ksi)--higher is better | 220 | 135 |
| Steel-bond (lbs)-higher is better | 100,000 | 65,000 |
| Toughness (in-lbs.)--higher is better | 70 | 24 |
| Erosion (in/hour)--smaller is better | 0.0026 | 0.0024 |

Table 1 shows that composition 1 of the present invention has improved performance in a number of important areas. To manufacture a bit body, sintered spherical tungsten carbide is infiltrated by an infiltration binder. The term "infiltration binder" herein refers to a metal or an alloy used in an infiltration process to bond particles of tungsten carbide together. Suitable metals include all transition metals, main group metals and alloys thereof. For example, copper, nickel, iron, and cobalt may be used as the major constituents in the infiltration binder. Other elements, such as aluminum, manganese, chromium, zinc, tin, silicon, silver, boron, and lead, also may be present in the infiltration binder.

The matrix body material in accordance with embodiments of the invention has many applications. Generally, the matrix body material may be used to fabricate the body for any earth-boring bit which holds a cutter or a cutting element in place. Such earth-boring bits include PDC drag bits, diamond coring bits, impregnated diamond bits, etc. These earth-boring bits may be used to drill a wellbore by contacting the bits with an earthen formation.

A PDC drag bit body manufactured according to embodiments of the invention is illustrated in FIG. 1. A PDC drag bit body is formed with faces 10 at its lower end. A plurality of recesses or pockets 12 are formed in the faces to receive a plurality of conventional polycrystalline diamond compact cutters 14. The PDC cutters, typically cylindrical in shape, are made from a hard material such as tungsten carbide and have a polycrystalline diamond layer covering the cutting face 13. The PDC cutters are brazed into the pockets after the bit body has been made. Methods of making polycrystalline diamond compacts are known in the art and are disclosed in U.S. Pat. Nos. 3,745,623 and 5,676,496, for example. Methods of making matrix bit bodies are known in the art and are disclosed for example in U.S. Pat. No. 6,287,360, which is assigned to the assignee of the present invention. These patents are hereby incorporated by reference.

In some embodiments of the present invention, cast tungsten carbide is mixed with spherical sintered tungsten carbide before infiltration. In a particular embodiment, composition 1 is altered to include 25% by weight cast tungsten carbide. Therefore, the resulting composition is 47% spherical sintered tungsten carbide, 25% cast tungsten carbide, 20% carburized tungsten carbide, 6% nickel and 2% iron. Generally speaking, the addition of cast tungsten carbide to a matrix improves the erosion resistance, but at the expense of strength and toughness.

However, the spherical sintered carbide disclosed herein provides such an increase in the strength and toughness that even with the addition of 25% by weight cast carbide to the spherical sintered carbide mix, a 20% improvement in the erosion resistance occurs with less than a 10% drop in the strength and toughness values. Note that, in alternate embodiments, the cast carbide may be present in an amount ranging from about 1% to about 25% by weight of the composition. Other types of carbides may be used in conjunction with the sintered spherical carbides disclosed herein. Depending on a user's requirements, different types of carbides may be used in order to tailor particular properties.

In applications where the erosion resistance is more important than that of transverse rupture strength and toughness, either crushed cast carbide or spherical cast carbide (or both) can be added from 15% to 50% by weight. In other applications where an optimum degree of strength, toughness and erosion resistance is warranted, the aforementioned types of cast carbides in the range of 5% to 30% is desired along with spherical sintered cast carbide. Yet another application, a mixture of 5% to 40% carburized tungsten carbide, 10% to 25% cast carbide, up to 10% metallic addition is desired along with spherical cast carbide.

In some embodiments, a mixture is obtained by mixing particles of spherical sintered tungsten carbide and cast tungsten carbide with nickel powder, and the mixture is then infiltrated by a suitable infiltration binder, such as a copper-based alloy. The nickel powder has an average particle size of about 5–25 μm, although other particle sizes may also be used.

The mixture includes preferably at least 80% by weight of the total carbide. While reference is made to tungsten carbide, other carbides of Group VIIIB metals may be used. Although the total carbide may be used in an amount less than 80% by weight, such matrix bodies may not possess the desired physical properties to yield optimal performance.

Sintered spherical tungsten carbide preferably is present in an amount ranging from about 30% to about 99% by weight, although less spherical sintered tungsten carbide also is acceptable. The more preferred range is from about 45% to 85% by weight.

Nickel powder and/or iron is present as the balance of the mixture, typically from about 2% to 12% by weight. In addition to nickel and/or iron, other Group VIIIB metals such as cobalt and alloys also may be used. For example, it is expressly within the scope of the present invention that Co is present as the balance of the mixture in a range of about 2% to 15% by weight. Such metallic addition in the range of about 1% to about 12% may yield higher matrix strength and toughness, as well as higher braze strength.

Advantages of the present invention may include one or more of the following. In one or more embodiments, because sintered spherical tungsten carbide is used as the main carbide of a composition for forming a matrix body, a higher packing density of the sintered spherical tungsten carbide increases a strength, toughness, and durability of the matrix body.

In one or more embodiments, sintered spherical carbide pellets are used in a composition for forming a matrix body, capillary pathways within the composition are more uniform and narrow. Advantageously, a driving force for capillary infiltration is increased, and, thus, the carbide is able to form stronger bonds with an infiltrant.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit, comprising:

a bit body, the bit body comprising:

a matrix body, the matrix body comprising:

sintered spherical tungsten carbide, wherein the sintered spherical tungsten carbide has an average tungsten carbide particle size in a range of 1 μm to 5 μm; and an infiltration binder including one or more metals or alloys; and at least one cutting element disposed on the bit body.

2. The drill bit of claim 1, wherein the infiltration binder comprises a Group VIIIB metal selected from a group consisting of Ni, Co, Fe, and alloys thereof.

3. The drill bit of claim 2, wherein the infiltration binder further comprises at least one metal selected from a group consisting of Al, Mn, Cr, Zn, Sn, Si, Ag, B, and Pb.

4. The drill bit of claim 1, wherein the matrix body further comprises a Group VIIIB metal selected from one of Ni, Co, Fe, and alloys thereof.

5. The drill bit of claim 4, wherein the Group VIIIB metal is Ni and has an average particle size in a range of 5 μm to 25 μm.

6. The drill bit of claim 1, wherein the matrix body further comprises cast tungsten carbide.

7. The drill bit of claim 1, wherein the matrix body further comprises a mixture of carburized tungsten carbide and cast tungsten carbide.

8. The drill bit of claim 6, wherein the cast tungsten carbide is present in an amount up to 50% by weight of the matrix body.

9. The drill bit of claim 6, wherein the cast tungsten carbide is selected from at least one of crushed cast tungsten carbide and spherical cast tungsten carbide.

10. The drill bit of claim 7, wherein the matrix body comprises from 5% to 40% carburized tungsten carbide and from 10% to 25% cast tungsten carbide.

11. A composition for forming a matrix body, comprising:

a mixture of tungsten carbide including sintered spherical tungsten carbide; and an infiltration binder including one or more metals or alloys, wherein the mixture of tungsten carbide further includes a mixture of carburized tungsten carbide and cast tungsten carbide and wherein the mixture of carburized tungsten carbide and cast tungsten carbide is present in a ratio of about 45% by weight of the composition.

12. The composition of claim 11, wherein the mixture of tungsten carbide is present in a ratio of at least 80% by weight of the composition.

13. The composition of claim 11, wherein the infiltration binder comprises a Group VIIIB metal selected from a group consisting of Ni, Co, Fe, and alloys thereof.

14. The composition of claim 13, wherein the infiltration binder further comprises at least one metal selected from a group consisting of Al, Mn, Cr, Zn, Sn, Si, Ag, B, and Pb.

15. The composition of claim 11, further comprising a Group VIIIB metal selected from a group consisting of Ni, Co, Fe, and alloys thereof.

* * * * *